US008636858B2

(12) United States Patent
Takeda et al.

(10) Patent No.: US 8,636,858 B2
(45) Date of Patent: Jan. 28, 2014

(54) PRODUCTION EQUIPMENT AND PRODUCTION METHOD FOR PRECIPITATION HARDENED ALLOY STRIP

(75) Inventors: Mahoto Takeda, Yokohama (JP); Naokuni Muramatsu, Nagoya (JP); Nobuyuki Ogawa, Handa (JP)

(73) Assignees: NGK Insulators, Ltd., Nagoya (JP); National University Corporation Yokohama National University, Yokohama-Shi (JP)

( * ) Notice: Subject to any disclaimer, the term of this patent is extended or adjusted under 35 U.S.C. 154(b) by 420 days.

(21) Appl. No.: 12/925,317

(22) Filed: Oct. 19, 2010

(65) Prior Publication Data

US 2011/0094636 A1 Apr. 28, 2011

(30) Foreign Application Priority Data

Oct. 22, 2009 (JP) ..... 2009-243580

(51) Int. Cl.
*C21D 9/573* (2006.01)

(52) U.S. Cl.
USPC ..... 148/658; 148/688

(58) Field of Classification Search
USPC ..... 148/688, 658
See application file for complete search history.

(56) References Cited

U.S. PATENT DOCUMENTS

| | | | | | |
|---|---|---|---|---|---|
| 3,201,287 | A | | 8/1965 | Flowers | |
| 3,682,712 | A | * | 8/1972 | Vernier | 148/688 |
| 4,241,903 | A | * | 12/1980 | Hellman | 266/109 |
| 5,182,074 | A | * | 1/1993 | Yoshioka et al. | 266/87 |

FOREIGN PATENT DOCUMENTS

| | | | |
|---|---|---|---|
| GB | 481379 | | 3/1938 |
| JP | 60-255933 | | 12/1985 |
| JP | 61-136634 | A1 | 6/1986 |
| JP | 62-023936 | | 1/1987 |
| JP | 63-303013 | A1 | 12/1988 |
| JP | 2-073923 | | 3/1990 |
| JP | 05-074553 | AI | 3/1993 |
| JP | 06-272003 | A1 | 9/1994 |
| JP | 10-310855 | A1 | 11/1998 |
| JP | 2008-248342 | A1 | 10/2008 |

* cited by examiner

*Primary Examiner* — Scott Kastler
(74) *Attorney, Agent, or Firm* — Burr & Brown, PLLC

(57) ABSTRACT

In the production equipment for a precipitation hardened alloy strip, a solution treatment unit includes a heating chamber provided to heat the material alloy strip having a precipitation hardening alloy composition to a temperature of not lower than a recrystallization temperature but not higher than a melting point, a cooling chamber located adjacent to the heating chamber, and a pair of cooling rolls incorporated in the cooling chamber to hold therebetween and cool down the material alloy strip heated in the heating chamber. This production equipment can quench the material alloy strip to form a solid solution supersaturated with precipitation hardening elements and thereby forming a precipitation hardened alloy strip having a good shape and a favorable surface condition.

4 Claims, 5 Drawing Sheets
(1 of 5 Drawing Sheet(s) Filed in Color)

PRODUCTION EQUIPMENT AND PRODUCTION METHOD FOR PRECIPITATION HARDENED ALLOY STRIP

BACKGROUND OF THE INVENTION

1. Field of the Invention

The present invention relates to production equipment and a production method for precipitation hardened alloy strip.

2. Description of the Related Art

One proposed structure of production equipment for alloy strip has temperature-controlling single rolls arranged in zig-zag to be in contact with heated alloy strip and alternately quench one face, the surface or the rear face of the heated alloy strip (see, for example, Patent Document 1). The production equipment disclosed in Patent Document 1 is supposed to have a high energy efficiency for cooling and save both the power consumption and the installation space. Another proposed structure of production equipment has a cooling chamber located on a heat treatment metal material discharge side of an annealing furnace. Spray nozzles are provided in the cooling chamber to cool down the metal material. The pressure of an atmospheric gas in the annealing furnace is made higher than a gas pressure in the cooling chamber, so that the gas is flowed from the annealing furnace to the cooling chamber (see, for example, Patent Document 2). The production equipment disclosed in Patent Document 2 is supposed to prevent penetration of the water vapor into the furnace and assure the uniform finish shape of the metal material.

Patent Document 1: Japanese Patent Laid-Open No. H06-272003

Patent Document 2: Japanese Paten Laid-Open No. S63-303013

SUMMARY OF THE INVENTION

The production equipment disclosed in Patent Document 1 cools down only one face, the surface or the rear face, of the alloy strip each time and may cause insufficient quenching. The difference of the cooling timing between the surface and the rear face may result in uneven cooling of the alloy strip in the strip thickness direction and cause the warping or the twisting of the alloy strip. The production equipment disclosed in Patent Document 2, on the other hand, utilizes the pressure difference to prevent penetration of the water vapor into the furnace. There would be, however, a further demand for more effectively preventing penetration of the water vapor and giving an alloy strip having a better surface condition. It is not easy to uniformly spray the jets of cooling water onto the alloy strip from the spray nozzles. There would thus be a further demand for attaining the more uniform cooling and giving an alloy strip having a better shape.

By taking into account the issue discussed above, an object of the present invention is to provide production equipment and a production method for precipitation hardened alloy strip, which is structured to quench an alloy strip and give a precipitation hardened alloy strip having a good shape and a favorable surface condition.

The inventors have intensively studied to attain at least part of the object mentioned above and the other relevant requirements and have completed the present invention based on the finding that a pair of cooling rolls adopted to hold an alloy strip therebetween effectively quenches the alloy strip and gives a precipitation hardened alloy strip having a good shape and a favorable surface condition.

According to one aspect of the present invention, there is provided production equipment for precipitation hardened alloy strip. The production equipment has a heating chamber provided to heat material alloy strip having a precipitation hardening alloy composition to a temperature of not lower than a recrystallization temperature but not higher than a melting point; a cooling chamber located adjacent to the heating chamber; and a pair of cooling rolls incorporated in the cooling chamber to hold therebetween and cool down the material alloy strip heated in the heating chamber.

The production equipment for the precipitation hardened alloy strip according to this aspect of the invention uses the pair of cooling rolls to simultaneously cool down the alloy strip on both faces. This arrangement assures the high cooling efficiency and thereby enables the alloy strip to be quenched. Compared with using one single roll, using the pair of cooling rolls allows for reduction of the heat capacity and the diameter of each cooling roll and thereby shortens the distance and the time interval until the start of cooling the heated alloy strip, thus enhancing the temperature decrease rate. This cooling mechanism adopted in the invention has a lower potential for generation of the water vapor, compared with a cooling mechanism of spraying the flow of cooling water. There is accordingly no need for setting a wide distance between the heating chamber and the cooling device, for the purpose of preventing penetration of the water vapor into the heating chamber. The narrower distance assures the higher temperature decrease rate. As the alloy strip is in contact with the cooling rolls, linear contact areas of the alloy strip are cooled down simultaneously on the surface and the rear face by the pair of cooling rolls. This lowers the potential of uneven cooling and gives a precipitation hardened alloy strip having a good shape. The application of the cooling rolls for cooling does not require any equipment as the source of water vapor in the cooling chamber and allows for restriction of water vapor-induced oxide coating, thus giving a precipitation hardened alloy strip having a favorable surface condition.

The strip of this embodiment is defined to have a thickness of not greater than 1.00 mm.

BRIEF DESCRIPTION OF THE DRAWINGS

The patent or application file contains at least one drawing executed in color. Copies of this patent or patent application with color drawing(s) will be provided by the Office upon request and payment of the necessary fee.

DETAILED DESCRIPTION OF THE INVENTION

Figure 1:
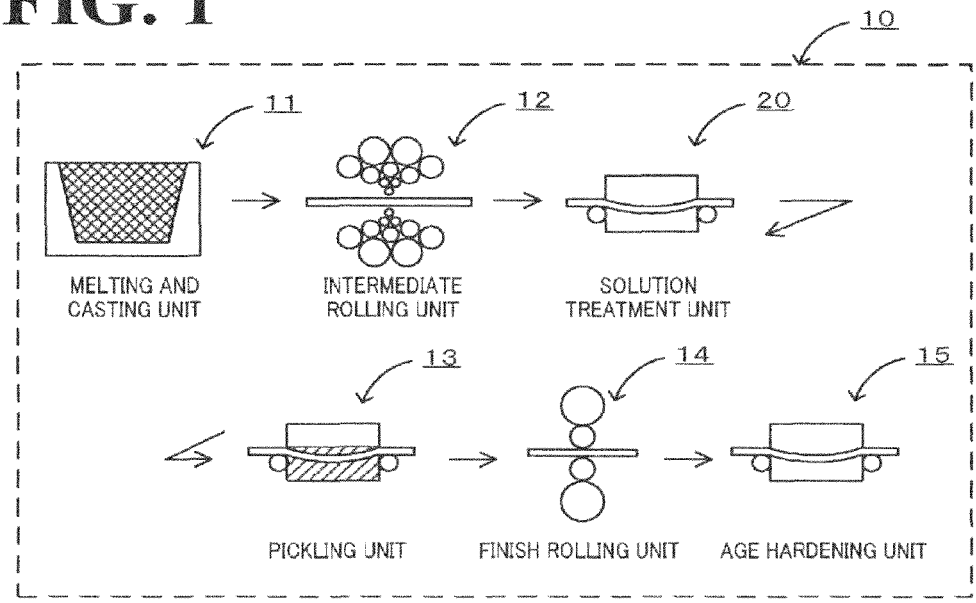
FIG. 1 is a diagrammatic representation of one exemplary configuration of production equipment 10 according to the invention.

One embodiment of the invention is described with reference to the accompanied drawings. FIG. 1 is a diagrammatic representation of one exemplary configuration of production equipment 10 according to the invention. The production equipment 10 is used to produce precipitation hardened alloy strip. The production equipment 10 includes a melting and casting unit 11 structured to melt a material mixture and cast the molten material mixture to have a precipitation hardening alloy composition, an intermediate rolling unit 12 structured to cold roll the alloy ingot having the precipitation hardening alloy composition to a desired thickness to material alloy strip, and a solution treatment unit 20 structured to quench the material alloy strip and thereby form a solid solution supersaturated with precipitation hardening elements. The production equipment 10 includes a pickling unit 13 structured to clean the material alloy strip after the solution treatment, a finish rolling unit 14 structured to cold roll the cleaned material alloy strip to a further desired thickness, and an age hardening unit 15 structured to make the finish-rolled material alloy strip subject to age hardening treatment and thereby lead to secondary phase precipitation simultaneously with elimination of plastic strain caused by the finish rolling.

Figure 2:
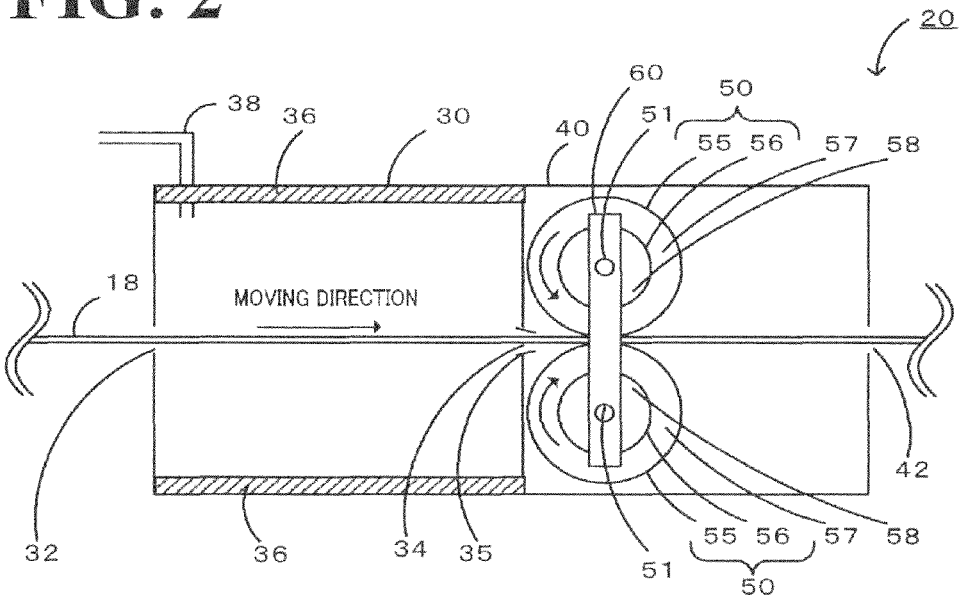
FIG. 2 is a diagrammatic representation of one exemplary structure of a solution treatment unit 20.

FIG. 2 is a diagrammatic representation of one exemplary structure of the solution treatment unit 20 in the production equipment according to one embodiment of the invention. The solution treatment unit 20 includes a heating chamber 30 provided to heat material alloy strip 18 having a precipitation hardening alloy composition to a temperature of not lower than a recrystallization temperature but not higher than a melting point, a cooling chamber 40 located adjacent to the heating chamber 30, and a pair of cooling rolls 50 incorporated in the cooling chamber 40 to hold therebetween and cool down the material alloy strip 18 heated in the heating chamber 30. The solution treatment unit 20 allows the material alloy strip to be subject to the solution treatment during continuous run, to be heated in the heating chamber 30, and to be quenched in the cooling chamber 40 with the cooling rolls 50.

The heating chamber 30 heats material alloy strip 18 having the precipitation hardening alloy composition to the temperature of not lower than the recrystallization temperature and not higher than the melting point. The process of heating to the temperature of not lower than the recrystallization temperature and not higher than the melting point and subsequent quenching forms a solid solution supersaturated with precipitation hardening elements. Typical examples of the precipitation hardening alloy composition include stainless steel 600 series, aluminum alloys 2000 series, 6000 series, and 7000 series, and copper alloys. Among them, the copper alloys are especially preferable. The copper alloys are typically adopted for electronic parts because of the high conductivity and have a high demand for size reduction and thickness reduction. The application of the technique of the invention to the copper alloy is thus of great significance to give thin and small-sized alloy strip in a desired shape. Preferable examples are beryllium-cobalt, nickel-silicon, titanium-iron, and chromium-zirconium copper alloy systems. These copper alloy systems lead to precipitation of the secondary phase from the supersaturated solid solution. One example of the precipitation hardening alloy composition may contain 1.90% by mass of beryllium and 0.20% by mass of cobalt. Another example may contain 2.40% by mass of nickel and 0.60% by mass of silicon. Another example may contain 3.2% by mass of titanium and 0.20% by mass of iron. Another example may contain 0.30% by mass of chromium and 0.12% by mass of zirconium. The basic concept of the invention is also effective for solid solution hardening alloys and spinodal decomposition-type alloys, although these alloys adopt different hardening mechanisms and are thus distinguished from the precipitation hardened alloys. The solid solution hardening alloy is strengthened by quenching to maximize the solid solution of the solute elements. The spinodal decomposition-type alloy is strengthened by decomposition of the supersaturated solid solution to form a periodical modulated structure at the age hardening step.

The heating chamber 30 has an inlet opening 32 formed to receive and introduce the material alloy strip 18, a transport opening 34 located between the heating chamber 30 and the cooling chamber 40 to transport the material alloy strip 18 toward the cooling chamber 40, a heating device 36 designed to heat the inside of the heating chamber 30 with an electric heater, and a gas pipe 38 arranged to deliver an inert gas into the heating chamber 30. The gas pipe 38 is connected with a gas cylinder (not shown) to continuously supply the inert gas into the heating chamber 30 and maintain the inert gas atmosphere inside the heating chamber 30. Maintaining the inert gas atmosphere interferes with excessive oxidation of the material alloy strip 18 and keeps the surface of the material alloy strip 18 in a favorable state. The inert gas is preferably any one of argon gas, helium gas, and nitrogen gas. The gas pipe 38 is equipped with a regulator (not shown) to deliver a higher pressure of the inert gas than the internal pressure of the cooling chamber. This makes the internal pressure of the heating chamber 30 higher than the internal pressure of the cooling chamber 40 to effectively prevent the water vapor and the air from penetrating from the cooling chamber into the heating chamber, thus keeping the surface of the material alloy strip 18 in a favorable state. The pressure difference between the heating chamber 30 and the cooling chamber 40 is preferably not lower than 100 hPa and not higher than 500 hPa. The pressure difference of not lower than 100 hPa effectively prevents penetration of the water vapor and the air into the heating chamber. The pressure difference of not higher than 500 hPa prevents an excessively high flow-out rate of the atmosphere gas from the heating chamber and saves the consumption of the inert gas, while preventing a decrease in cooling efficiency caused by an excessively high flow-in rate of the hot blast into the cooling chamber. It is preferable to maintain the internal pressure of the heating chamber 30 and the internal pressure of the cooling chamber 40 slightly higher than the atmospheric pressure. This readily prevents the inflow of the atmosphere gas from the outside into the heating chamber 30 and the cooling chamber 40. The heating chamber 30 communicates with the cooling chamber 40 via the transport opening 34 formed as the passage of the material alloy strip 18. This arrangement causes the inert gas to flow along the material alloy strip 18 and prevents the material alloy strip 18 that is not sufficiently cooled down from coming into contact with the oxygen or water vapor. The inert atmosphere gas flowing into the cooling chamber 40 preferably prevents dew condensation on the surface of the cooling rolls 50 and inhibits generation of the water vapor. The transport opening 34 has a baffle plate 35 arranged to have a decreasing opening area toward the cooling chamber. This arrangement further prevents penetration of the water vapor from the cooling chamber. The combination of the gas pipe 38 with the gas cylinder and the regulator corresponds to the atmosphere making mechanism and the pressure regulating mechanism of the invention.

The cooling chamber 40 is adjacent to the heating chamber 30 and includes the pair of cooling rolls 50. The adjacent arrangement of the cooling chamber 40 to the heating chamber 30 enables the material alloy strip 18 to be quenched immediately after being heated in the heating chamber 30, thus shortening the time interval between heating and quenching and enhancing the temperature decrease rate of the material alloy strip 18.

The pair of cooling rolls 50 are incorporated in the cooling chamber 40 and are located nearby the transport opening 34 to hold therebetween and cool down the material alloy strip 18 heated in the heating chamber 30. The cooling rolls 50 are supported in a rotatable manner by a shaft 51. The material alloy strip 18 heated in the heating chamber 30 is held between the pair of cooling rolls 50 and is cooled down on both faces. This arrangement assures the high cooling efficiency and enables the material alloy strip 18 to be quenched. Compared with using one single roll, using the pair of cooling rolls allows for reduction of the heat capacity and the diameter of each cooling roll and thereby shortens the distance and the time interval until the start of cooling the heated alloy strip, thus enhancing the temperature decrease rate. This cooling mechanism adopted in the embodiment has a lower potential for generation of the water vapor, compared with a cooling mechanism of spraying the flow of cooling water. There is accordingly no need for setting a wide distance between the heating chamber and the cooling device, for the purpose of preventing penetration of the water vapor into the heating chamber. The narrower distance assures the higher temperature decrease rate. As the material alloy strip 18 is in contact with the cooling rolls 50, linear contact areas of the material alloy strip 18 are cooled down simultaneously on the surface and the rear face by the pair of cooling rolls 50. This lowers the potential of uneven cooling and keeps the material alloy strip 18 in a good shape, which preferably leads to the non-requirement for any additional step or equipment of correcting the shape (for example, a leveler). The application of the cooling rolls for cooling does not require any equipment as the source of water vapor in the cooling chamber and thereby prevents excessive oxide coating due to the water vapor.

The pair of cooling rolls 50 are designed to have an identical diameter and satisfy a condition of $(200\times T)\leq D\leq(2000\times T)$, where D (mm) denotes a diameter and T (mm) denotes a thickness of the material alloy strip 18. The rolling rolls 50 satisfying a condition of $(222\times T)\leq D\leq(2000\times T)$ are preferable. The cooling rolls 50 of the identical diameter enable the heated material alloy strip 18 to be uniformly cooled down on both faces and to be kept in a good shape. The condition of $(200\times T)\leq D$ is sufficient for quenching the material alloy strip 18 and allows for water passage having a sufficient water flow rate to attain a desired temperature decrease rate and forming the turbulence. The condition of $D\leq(2000\times T)$ shortens the distance and the time interval before the heated material alloy strip 18 is cooled down by the cooling rolls 50, thereby enhancing the temperature decrease rate and saving the space. The material alloy strip 18 has a thickness of not greater than 1.00 mm, preferably a thickness of not less than 0.05 mm and not greater than 0.90 mm, and more preferably a thickness of not less than 0.08 mm and not greater than 0.30 mm. The diameter D is preferably not less than 50 mm and not greater than 240 mm and more preferably not less than 60 mm and not greater than 200 mm. The cooling rolls 50 are not used to roll and extend the material alloy strip 18 but are designed to have substantially zero difference of the plate thickness of the material alloy strip 18 before and after the cooling step with the cooling rolls 50.

The cooling chamber 40 with the pair of built-in cooling rolls 50 is structured to quench the material alloy strip 18 at a temperature decrease rate of not lower than 275° C./s until the temperature of the material alloy strip 18 is lowered to or below 50° C. This arrangement assures formation of a solid solution supersaturated with the precipitation hardening elements in a favorable condition with regard to precipitation hardened alloy strip or more specifically precipitation hardened copper alloy strip. The solution treatment temperature of the precipitation hardened copper alloy strip is generally in a range of about 600° C. to about 1000° C. In order to keep the supersaturated condition over a significant temperature change from this solution treatment temperature to or below 50° C. causing no change of the internal texture, completion of the cooling step within about 2 to 3 seconds is required. Quenching at this high temperature decrease rate is especially suitable for solution treatment of the precipitation hardened copper alloy strip. The roll diameter range mentioned above is adequate to attain this high temperature decrease rate. It is preferable to similarly adopt the high temperature decrease rate of 275° C./s for precipitation hardened iron alloys and precipitation hardened aluminum alloys.

Each of the cooling rolls 50 has an outer cylinder 55 with its outer circumference that is directly in contact with the material alloy strip 18 and an inner cylinder 56 provided inside the outer cylinder 55 and arranged coaxially with the outer cylinder 55. The cooling roll 50 includes a surface layer flow path 57 formed as a flow path of a cooling fluid between the outer cylinder 55 and the inner cylinder 56, an inner layer flow path 58 formed inside the inner cylinder 56, and a connection flow path 59 arranged to connect the surface layer flow path 57 with the inner layer flow path 58. Namely the flow of cooling fluid is exchangeable between the surface layer flow path 57 and the inner layer flow path 58. This arrangement enables the cooling fluid cooled down in the inner layer flow path 58 to be flowed into the surface layer flow path 57, while enabling the cooling fluid heated in the surface layer flow path 57 to be flowed into the inner layer flow path 58, thus allowing for the efficient cooling. The surface layer flow path 57, the inner layer flow path 58, and the connection flow path 59 are interconnected to circulate the cooling fluid. The circulation of the cooling fluid enhances the cooling efficiency. The cooling fluid is not specifically limited, but water or a conventional coolant (e.g., aqueous solution of ethylene glycol) is preferably used as the cooling fluid.

Figure 3:
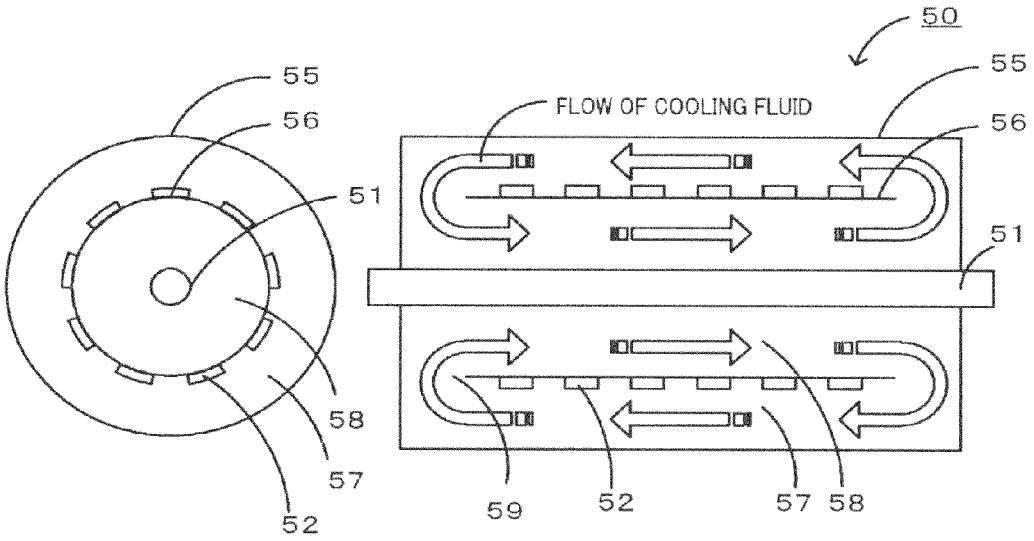
FIG. 3 is a diagrammatic representation of one example of a cooling roll with projections.

The cooling roll 50 further has a turbulence generation mechanism 52. The turbulence generation mechanism 52 includes substantially rectangular parallelepiped projections formed on an outer circumference of the inner cylinder 56 facing the surface layer flow path 57 and arranged at equal intervals both in an axial direction and in a circumferential direction. The turbulence generation mechanism 52 generates a turbulent flow of the cooling fluid at least in the surface layer flow path 57 in the cooling roll 50. FIG. 3 is a diagrammatic representation of the cooling roll 50 with such projections as the turbulence generation mechanism 52. The turbulent flow of the cooling fluid in the surface layer flow path 57 cools down the outer cylinder 55 with the high efficiency and thereby enhances the temperature decrease rate of the material alloy strip 18.

The cooling roll 50 is connected with a motor (not shown), which is driven to control the tangential speed of rotation equal to the moving speed of the material alloy strip 18. Such control effectively protects the surface of the material alloy strip 18 from being scratched and prevents a potential shape defect due to hindrance to the movement of the material alloy strip 18 or due to generation of the frictional heat between the cooling roll 50 and the material alloy strip 18 and the resulting non-uniform cooling of the material alloy strip 18.

The pair of cooling rolls 50 have a pressing mechanism 60 provided to correct the flatness of the material alloy strip 18. The pressing mechanism 60 includes support members provided on both ends of the shaft 51 to support the shaft 51 in vertically movable and rotatable manner and coil springs provided on both ends of the shaft 51 to press the shaft 51 toward the material alloy strip 18. The pressing mechanism 60 further works to keep the material alloy strip 18 in a good shape. The pressing mechanism 60 is designed preferably to press the material alloy strip 18 to a certain extent causing no substantial decrease of the plate thickness, in order to prevent processing-induced phase transformation. The pressing force is preferably a pressure of greater than 1/100 but less than 1/2 of an elastic limit A of the material alloy strip 50 immediately after being heated in the heat chamber 30. It is preferable to press the material alloy strip 18 via the cooling rolls 50. The more preferable pressing force is a pressure of not less than 1/50 and not greater than 1/5 of the elastic limit A. The pressing force of greater than 1/100 of the elastic limit A corrects the flatness, whereas the pressing force of less than 1/2 reduces decrease of the plate thickness. Pressing the cooling rolls 50 against the material alloy strip 18 linearly along its width with a load of not less than 1/50 and not greater than 1/5 of the elastic limit A effectively keeps the uniformity and the flat shape of the material alloy strip 18.

The operations of the production equipment 10 of the invention shown in FIG. 1 are described below. The production equipment 10 of the invention has a controller (e.g., computer) (not shown). When the operator operates the controller to enter setting values, the controller controls the respective units according to the input setting values. According to one embodiment, production of beryllium copper alloy strip as one exemplary precipitation hardened alloy strip is explained below. In response to the operator's input of setting values, the controller starts controlling the individual units to operate according to instructions given by the controller. More specifically, the material is molten and cast to billets by the melting and casing unit 11. Subsequently the cast billets are cold rolled to a preset thickness to give material alloy strip 18 by the intermediate rolling unit 12. The material alloy strip 18 is then subjected to solution treatment by the solution treatment unit 20 (FIG. 2). In the solution treatment unit 20, the material alloy strip 18 is continuously introduced through the inlet opening 32 into the heating chamber 30. The heating device 36 is controlled by the controller to maintain the heating chamber 30 at a preset temperature (for example, 800° C.). The flow of an inert gas (for example, nitrogen gas) having a higher pressure than the internal pressure of the cooling chamber 40 is continuously delivered through the gas pipe 38 into the heating chamber 30, so that the internal pressure of the heating chamber 30 is kept higher than the internal pressure of the cooling chamber 40. The material alloy strip 18 heated to the preset temperature is then continuously introduced through the transport opening 34 into the cooling chamber 40. The material alloy strip 18 is held by the pair of cooling rolls 50 and is cooled down. The cooling rolls 50 are driven by a motor (not shown) provided on the shaft 51 to control the tangential speed of rotation equal to the moving speed of the material alloy strip 18. The cooling fluid flows through the surface layer flow path 57, the inner layer flow path 58, and the connection flow path 59 formed in each of the cooling rolls 50 and is made turbulent by means of the projections 52. The material alloy strip 18 is quenched in the cooling chamber 40 with the cooling rolls 50 at a temperature decrease rate of, for example, 275° C./s until the temperature of the material alloy strip 18 is lowered to or below 50° C. and is discharged from an outlet opening 42. After washout and removal of scale accumulated on the surface of the discharged material alloy strip 18 in the pickling unit 13, the material alloy strip 18 is cold rolled to a desired thickness in the finishing roll unit 14. The cold-rolled material alloy strip 18 is then kept at an aging temperature in the age hardening unit 15 to induce precipitation of precipitation hardening elements and eliminate the plastic strain caused by finish rolling.

Next, a production method of precipitation hardened alloy strip of the invention is described below. This method includes a heating step of heating material alloy strip having a precipitation hardening alloy composition to a temperature of not lower than a recrystallization temperature but not higher than a melting point and a cooling step of holding the heated material alloy strip by a pair of cooling rolls and thereby cooling down the heated material alloy strip. The method may use the production equipment 10 described above. The conditions of the heating step and the cooling step may be those described above in relation to the production equipment 10. In the cooling step, it is preferable that the material alloy strip is cooled down at a temperature decrease rate of not lower than 275° C./s and not higher than 500° C./s until temperature of the material alloy strip is lowered to or below 50° C. This arrangement form a solid solution supersaturated desirably with precipitation hardening elements. The temperature decrease rate of the material alloy strip can be obtained from a time difference and a temperature difference between measurement points in a sequential measurement of the temperature of the material alloy strip, in a state where a thermocouple is welded to the surface center of the material alloy strip and a recording device is connected via an adequately long lead. It is preferable to determine the moving speed of the material alloy strip arbitrarily within a range of not less than 0.1 mm/min and not more than 20 m/min depending on solution treatment temperature, holding time, and the thickness of the material alloy strip. In the cooling step, it is preferable that the material alloy strip after being cooled down is pressed via the pair of cooling rolls at a pressure of not lower than 1/50 and not higher than 1/5 of an elastic limit of the material alloy strip. By pressing at pressure within this range along a line extending the width direction of the material alloy strip, uniformly flat shape can be obtained. It is preferable to use multiple pairs of cooling rolls in the cooling step, as described in FIG. 6. This arrangement desirably raises the temperature decrease rate in cooling start time where rapid quench is especially required and saves space in the cooling chamber. It is preferable that a distance between the pair of cooling rolls holding the material alloy strip is in a range of not less than 0.05 mm and not more than 1.00 mm. The thickness of the material alloy strip is adjusted accordingly to not less than 0.05 mm and not more than 1.00 mm.

The production equipment for the precipitation hardened alloy strip described above adopts the pair of cooling rolls to quench the material alloy strip and produce the precipitation hardened alloy strip in the good shape with the favorable surface condition.

The embodiment discussed above is to be considered in all aspects as illustrative and not restrictive. There may be various modifications, changes, and alterations without departing from the scope or spirit of the main characteristics of the present invention.

In the embodiment described above, the heating chamber 30 adopts the electric heater for the heating device 36. The heating device 36 is, however, not restricted to the electric heater but may be a direct heating system such as a burner, a radiation tube system such as a radiant tube, or an induction heating system. The heating device 36 is preferably designed to uniformly heat the material alloy strip 18 placed inside the heating chamber 30 and to control the temperature of the whole heating chamber 30 at a substantially constant level, which leads to homogeneous precipitation of the precipitation hardening elements.

In the embodiment described above, the heating chamber 30 includes the gas pipe 38 to deliver an inert gas into the heating chamber 30. The gas pipe 38 is connected with a gas cylinder and is equipped with a regulator. The gas pipe 38 is, however, not essential but may be omitted. In the production equipment 10 with little potential for evolution of water vapor, the precipitation hardened alloy strip with the favorable surface condition can be produced even without the gas pipe 38 and the relevant elements. In the embodiment, the baffle plate 35 is provided in the transport opening 34. The baffle plate 35 is, however, not essential but may be omitted. A modified structure without the baffle plate 35 still quenches the material alloy strip 18 and assures formation of precipitation hardened alloy strip in a good shape with a favorable surface condition.

In the embodiment described above, the pressure regulating mechanism adopts the gas pipe 38 provided in the heating chamber 30 to increase the internal pressure of the heating chamber 30. In addition to or in place of this structure, the pressure regulating mechanism may adopt a decompression device provided in the cooling chamber 40 to decrease the internal pressure of the cooling chamber 40. This modified structure also quenches the material alloy strip 18 and assures formation of precipitation hardened alloy strip in a good shape with a favorable surface condition.

In the embodiment described above, the pair of cooling rolls are arranged in a vertical direction. The orientation of the cooling rolls is, however, not restricted, and the pair of cooling rolls may be arranged in a horizontal direction. No limitation of the orientation of the cooling rolls is characteristically different from production equipment for cooling molten metal, such as strip cast metal.

In the embodiment described above, the pair of cooling rolls 50 are designed to have an identical diameter and satisfy the condition of $(200\times T)\leq D\leq(2000\times T)$, where D (mm) denotes the diameter and T (mm) denotes the thickness of the material alloy strip 18. This condition is, however, not essential but may be modified adequately to allow for desired quenching. Such modification also assures formation of precipitation hardened alloy strip in a good shape with a favorable surface condition.

In the embodiment described above, the cooling chamber 40 with the pair of built-in of cooling rolls 50 is structured to quench the material alloy strip 18 at a temperature decrease rate of not lower than 275° C./s. This arrangement is, however, not essential but may be modified adequately to allow for quenching required for the solution treatment. Such modification also assures formation of precipitation hardened alloy strip in a good shape with a favorable surface condition.

In the embodiment described above, the cooling roll 50 has the outer cylinder 55, the inner cylinder 56, the surface layer flow path 57, the inner layer flow path 58, and the connection flow path 59. This structure is, however, not essential but may be modified adequately. For example, the cooling roll 50 may be designed to have no flow path of the cooling fluid. The cooling roll 50 may have a single layer structure without the outer cylinder 55 and the inner cylinder 56 or a three or more layer structure, in placed of the two layer structure with the outer cylinder and the inner cylinder. The flow path of the cooling fluid may be arranged arbitrarily to allow for homogeneous and efficient cooling. Such modification also quenches the material alloy strip and assures formation of precipitation hardened alloy strip in a good shape with a favorable surface condition. In the embodiment, the surface layer flow path 57, the inner layer flow path 58, and the connection flow path 59 are interconnected to circulate the cooling fluid. This arrangement is, however, not essential but may be modified adequately. For example, the cooling fluid may be delivered from the outside into the surface layer flow path 57, flow through the connection flow path 59 and the inner layer flow path 58, and be discharged from the inner layer flow path 58 to the outside.

Figure 4:
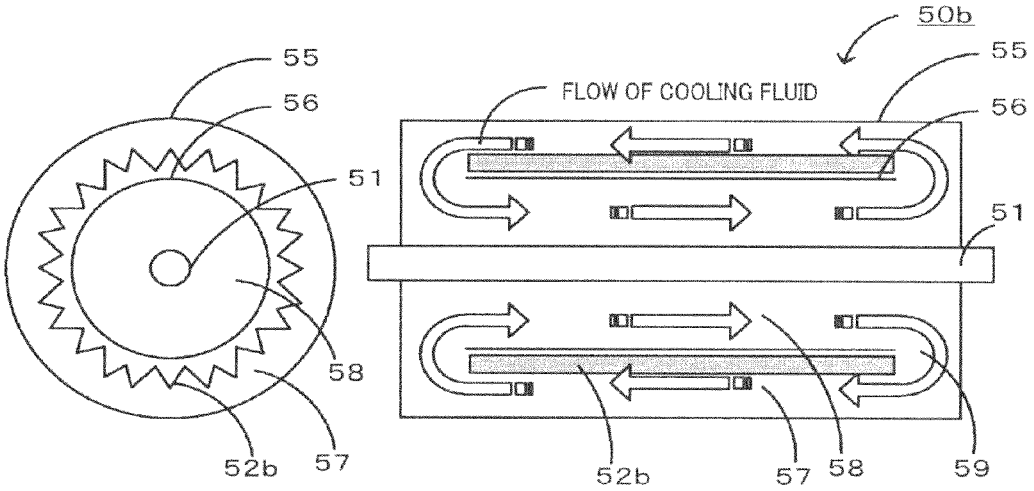
FIG. 4 is a diagrammatic representation of another example of the cooling roll with a bellows plate.
Figure 5:
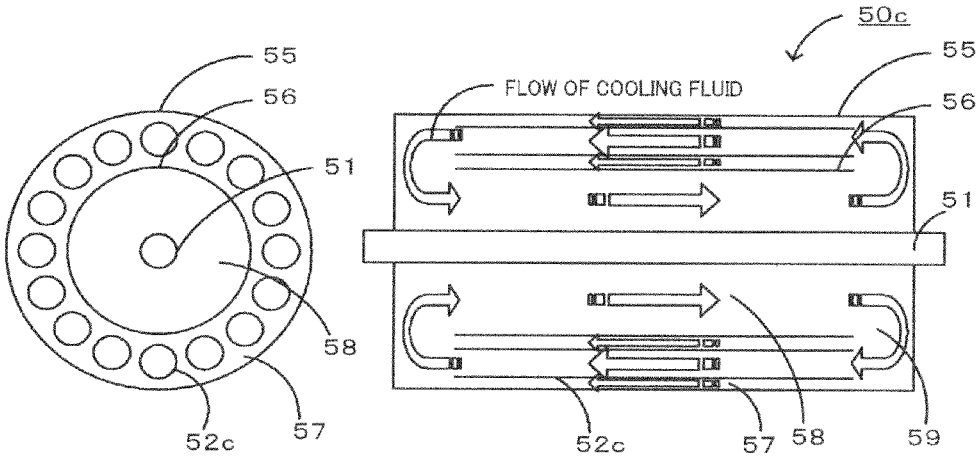
FIG. 5 is a diagrammatic representation of still another example of the cooling roll with pipes.

In the embodiment described above, the turbulence generation mechanism 52 has the rectangular parallelepiped projections formed on the outer circumference of the inner cylinder 56 facing the surface layer flow path 57 and arranged at substantially equal intervals both in the axial direction and in the circumferential direction (FIG. 3). The shape of the projections are, however, not restricted to the rectangular parallelepiped but may be any other suitable shape, for example, a cylinder, a cone, a triangular prism, or a triangular pyramid. The projections may be replaced by at least one of a concavo-convex structure, a mesh structure, a pipe structure, and an upright plate structure. FIG. 4 is a diagrammatic representation of another example of the cooling roll with a turbulence generation mechanism 52*b* (bellow plate) as one example of the concavo-convex structure. FIG. 5 is a diagrammatic representation of another example of the cooling roll with a turbulence generation mechanism 52*c* (pipes).

In the embodiment described above, the cooling roll 50 has the turbulence generation mechanism 52 to generate the turbulent flow of the cooling fluid at least in the surface layer flow path 57. The turbulence generation mechanism is, however, not essential but may be omitted or may be replaced by a mechanism of generating a laminar flow of the cooling fluid in the cooling roll. Such modification also quenches the material alloy strip and assures formation of precipitation hardened alloy strip in a good shape with a favorable surface condition.

In the embodiment described above, the cooling rolls 50 are controllable to make the tangential speed of rotation equal to the moving speed of the material alloy strip 18. This arrangement is, however, not essential but may be modified adequately. The adequate modification also quenches the material alloy strip and assures formation of precipitation hardened alloy strip in a good shape with a favorable surface condition.

In the embodiment described above, the pair of cooling rolls 50 are equipped with the pressing mechanism 60 to correct the flatness of the material alloy strip. The pressing mechanism 60 is, however, not essential but may be omitted. The cooling rolls 50 may be fastened in a rotatable manner. Such modification also quenches the material alloy strip and assures formation of precipitation hardened alloy strip in a good shape with a favorable surface condition.

In the embodiment described above, the pressing mechanism 60 has the coil springs. The coil springs are, however, not essential but may be replaced with, for example, at least one of an elastic body, a hydraulic pressure, a gas pressure, an electromagnetic force, a motor for pressurization, a gear, and a screw. The pressing mechanism 60 may be provided only on one of the cooling rolls 50, while the other rolling roll 50 may be fixed. The pressing mechanism 60 may be provided independently on both the cooling rolls 50 or may be provided commonly to be shared by the two cooling rolls 50.

Figure 6:
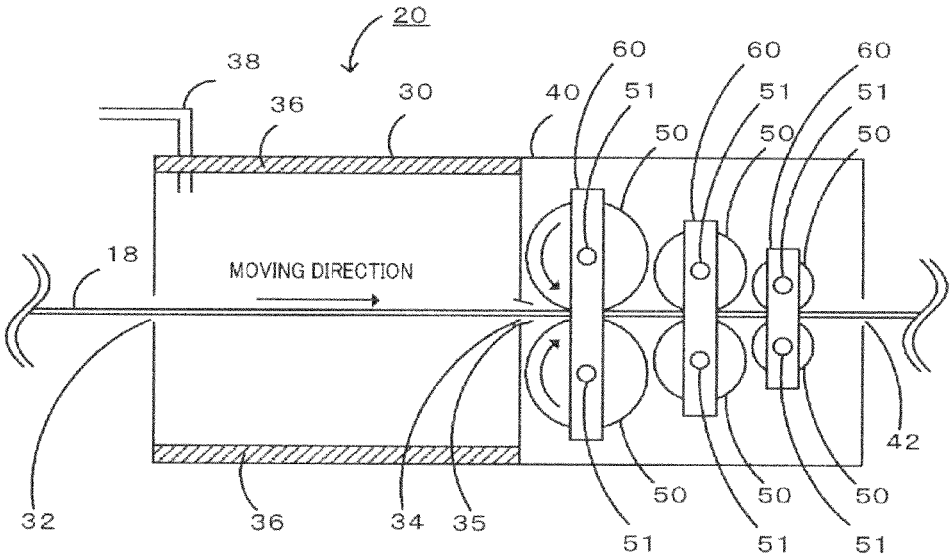
FIG. 6 is a diagrammatic representation of another exemplary structure of the solution treatment unit 20.

In the embodiment described above, the cooling chamber 40 is provided with the pair of built-in cooling rolls 50. The cooling chamber 40 may be provided with multiple pairs of built-in cooling rolls. The multiple pairs of built-in cooling rolls are used to successively cool down the material alloy strip 18. This modified arrangement effectively enhances the temperature decrease rate of the material alloy strip 18 and is thus suitable for quenching. This modified arrangement also improves the safety and the workability, since the material alloy strip discharged from the cooling chamber is fully cooled down to the ambient temperature. In the modified structure with multiple pairs of cooling rolls, the respective pairs of cooling rolls may have an identical diameter or different diameters. In one preferable structure, the multiple pairs of cooling rolls may be arranged such that one pair of cooling rolls closer to the heating chamber have the smaller diameter (FIG. 6). This arrangement enhances the temperature decrease rate at the initial stage of the cooling step having the higher demand for quenching, simultaneously with saving the space in the cooling chamber.

In the embodiment described above, the cooling rolls 50 are made of stainless steel. The material of the cooling rolls 50 is, however, not restricted to stainless steel. The cooling rolls 50 may be made of any of various other materials, although a metal material is preferable because of its high heat conductivity suitable for quenching and its easiness of surface smoothing. Stainless steel is one preferable material from the aspects of the corrosion resistance, the strength, and the high temperature resistance. Cupronickel having the high heat conductivity is capable of enhancing the temperature decrease rate and is thus preferable for the material of the cooling rolls 50. The cooling rolls 50 may be coated with a surface layer 10 made of at least one of chromium, zirconium, chromium compounds, and zirconium compounds. Coating with such a material having little reactivity with copper effectively prevents copper from adhering to the cooling rolls 50 in the production process of the copper alloy strip, and also prevents the adhering copper from being transferred to the material alloy strip 18. The thickness of the surface layer is preferably in a range of not less than 2 μm and not greater than 120 μm, more preferably in a range of not less than 3 μm and not greater than 100 μm, and most preferably in a range of not less than 5 μm and not greater than 97 μm. The thickness of not less than 2 μm gives a homogeneous surface layer that is not readily peeled off. The thickness of not greater than 120 μm does not lower the heat conductivity of the cooling rolls 50 and thereby allows the material alloy strip 18 to be quenched.

EXAMPLES

Some concrete examples of producing precipitation hardened alloy strips with the solution treatment unit 20 according to the invention are described below.

Example 1

A Cu—Be—Co alloy having a Cu-based composition Containing 1.90% by mass of Be and 0.20% by mass of Co was molten, cast, and cold rolled to prepare material alloy strip of 50 mm in width and 0.27 mm in thickness. The composition of the alloy was determined by the previous chemical analysis, and the thickness was measured with a micrometer. The prepared material alloy strip was subjected to continuous solution treatment as explained below. The material alloy strip was heated to 800° C. in a heating chamber kept under a pressure of 0.15 MPa in a nitrogen atmosphere. This temperature was indicated by a thermocouple located in the neighborhood of a terminal end of the heating chamber. The heated material alloy strip was continuously introduced through a transport opening into a connecting cooling chamber and was cooled down by a pair of cooling rolls located in the cooling chamber. Each of the cooling rolls was made of stainless steel (SUS316) and had a dual structure of an outer cylinder having a diameter of 120 mm and a thickness of 9 mm and an inner cylinder having a diameter of 60 mm and a thickness of 9 mm. The cooling rolls had projections as shown in FIG. 3. The surface of the outer cylinder was plated with a hard Cr layer having a film thickness of 5 μm. The film thickness was an observed value with a film thickness meter (Fisher Scope MMS-3AM manufactured by Kett Electric Laboratory). At the cooling step, the tangential speed of the cooling rolls was made equal to the moving speed of the material alloy strip. The pressing force of the cooling rolls was adjusted to attain a pressure ratio of 1/10 by means of coil springs. The pressing ratio represents division of a pressing force by an estimated elastic limit or an estimated value of elastic limit after the solution treatment. The resulting alloy strip was specified as an alloy strip of Example 1. The temperature of the alloy strip immediately after discharge from the cooling chamber (hereafter may be referred to as the out-furnace temperature) was 41° C. This temperature was measured with a contact-type thermometer.

Examples 2 to 7

An alloy strip of Example 2 was obtained according to the same procedure as that of Example 1, except that each of cooling rolls adopted had a dual structure of an outer cylinder having a diameter of 60 mm and a thickness of 5 mm and an inner cylinder having a diameter of 30 mm and a thickness of 5 mm. An alloy strip of Example 3 was obtained according to the same procedure as that of Example 1, except that the thickness of the material alloy strip was 0.10 mm and that each of cooling rolls adopted had a dual structure of an outer cylinder having a diameter of 200 mm and a thickness of 9 mm and an inner cylinder having a diameter of 140 mm and a thickness of 9 mm. An alloy strip of Example 4 was obtained according to the same procedure as that of Example 1, except that the surface of each of cooling rolls was plated with a hard Cr layer having a film thickness of 97 μm. An alloy strip of Example 5 was obtained according to the same procedure as that of Example 1, except that the thickness of the material alloy strip was 0.30 mm and that the pressing force was adjusted to attain a pressure ratio of 1/5. An alloy strip of Example 6 was obtained according to the same procedure as that of Example 1, except that the thickness of the material alloy strip was 0.08 mm and that the pressing force was adjusted to attain a pressure ratio of 1/50. An alloy strip of Example 7 was obtained according to the same procedure as that of Example 1, except that a cooling chamber was provided with three pairs of cooling rolls, where a first pair of cooling rolls closest to a heating chamber had a dual structure of an outer cylinder having a diameter of 120 mm and a thickness of 9 mm and an inner cylinder having a diameter of 60 mm and a thickness of 9 mm, a second pair of cooling rolls had an outer cylinder and an inner cylinder of the smaller diameters, and a third pair of cooling rolls had an outer cylinder and an inner cylinder of the further smaller diameters.

Example 8 and 9

An alloy strip of Example 8 was obtained according to the same procedure as that of Example 1, except that a Cu—Ni—Si alloy having a Cu-based composition containing 2.40% by mass of Ni and 0.60% by mass of Si was used, that the thickness of the material alloy strip was 0.15 mm, and that the heating temperature was 850° C. An alloy strip of Example 9 was obtained according to the same procedure as that of Example 8, except that the heating temperature was 700° C.

Examples 10 and 11

An alloy strip of Example 10 was obtained according to the same procedure as that of Example 1, except that a Cu—Cr—

Zr alloy having a Cu-based composition containing 0.30% by mass of Cr and 0.12% by mass of Zr was used, that the thickness of the material alloy strip was 0.20 mm, and that the heating temperature was 950° C. An alloy strip of Example 11 was obtained according to the same procedure as that of Example 10, except that the thickness of the material alloy strip was 0.15 mm and that the heating temperature was 770° C.

Example 12 to 20

An alloy strip of Example 12 was obtained according to the same procedure as that of Example 1, except that each of cooling rolls adopted had a dual structure of an outer cylinder having a diameter of 50 mm and a thickness of 5 mm and an inner cylinder having a diameter of 24 mm and a thickness of 5 mm. An alloy strip of Example 13 was obtained according to the same procedure as that of Example 1, except that each of cooling rolls adopted had a dual structure of an outer cylinder having a diameter of 240 mm and a thickness of 9 mm and an inner cylinder having a diameter of 120 mm and a thickness of 9 mm. An alloy strip of Example 14 was obtained according to the same procedure as that of Example 1, except that the surface of each of cooling rolls was plated with a hard Cr layer having a film thickness of 2 μm. An alloy strip of Example 15 was obtained according to the same procedure as that of Example 1, except that the surface of each of cooling rolls was plated with a hard Cr layer having a film thickness of 120 μm. An alloy strip of Example 16 was obtained according to the same procedure as that of Example 1, except that the rotation of cooling rolls was temporarily stopped and that no pressing force was applied to the cooling rolls. An alloy strip of Example 17 was obtained according to the same procedure as that of Example 1, except that the pressing force was adjusted to attain a pressure ratio of 1/100. An alloy strip of Example 18 was obtained according to the same procedure as that of Example 1, except that the pressing force was adjusted to attain a pressure ratio of 1/2. An alloy strip of Example 19 was obtained according to the same procedure as that of Example 13, except that the thickness of the material alloy strip was 0.60 mm. An alloy strip of Example 20 was obtained according to the same procedure as that of Example 13, except that the thickness of the material alloy strip was 0.95 mm.

Examples 21 and 22

An alloy strip of Example 21 was obtained according to the same procedure as that of Example 3, except that the material alloy strip was made of stainless steel (SUS630) having a thickness of 0.80 mm, that the heating temperature was 1060° C., and that the pressing force was adjusted to attain a pressure ratio of 1/5. An alloy strip of Example 22 was obtained according to the same procedure as that of Example 1, except that the material alloy strip was made of stainless steel (SUS630) having a thickness of 0.30 mm and that the heating temperature was 1060° C.

Examples 23 and 24

An alloy strip of Example 23 was obtained according to the same procedure as that of Example 3, except that the material alloy strip was made of an aluminum alloy (A6061) having a thickness of 0.90 mm and that the heating temperature was 530° C. An alloy strip of Example 24 was obtained according to the same procedure as that of Example 1, except that the material alloy strip was made of an aluminum alloy (A6061) having a thickness of 0.40 mm and that the heating temperature was 520° C.

Reference Examples 1 to 3

An alloy strip of Reference Example 1 was obtained according to the same procedure as that of Example 1, except that cooling rolls were not adopted and that the alloy strip was cooled down by spraying jets of cooling water from spray nozzles. An alloy strip of Reference Example 2 was obtained according to the same procedure as that of Reference Example 1, except that the material alloy strip was made of stainless steel (SUS630) having a thickness of 0.30 mm and that the heating temperature was 1060° C. An alloy strip of Reference Example 3 was obtained according to the same procedure as that of Reference Example 1, except that the material alloy strip was made of an aluminum alloy (A6061) having a thickness of 0.40 mm and that the heating temperature was 520° C.

Evaluations

Figure 7:
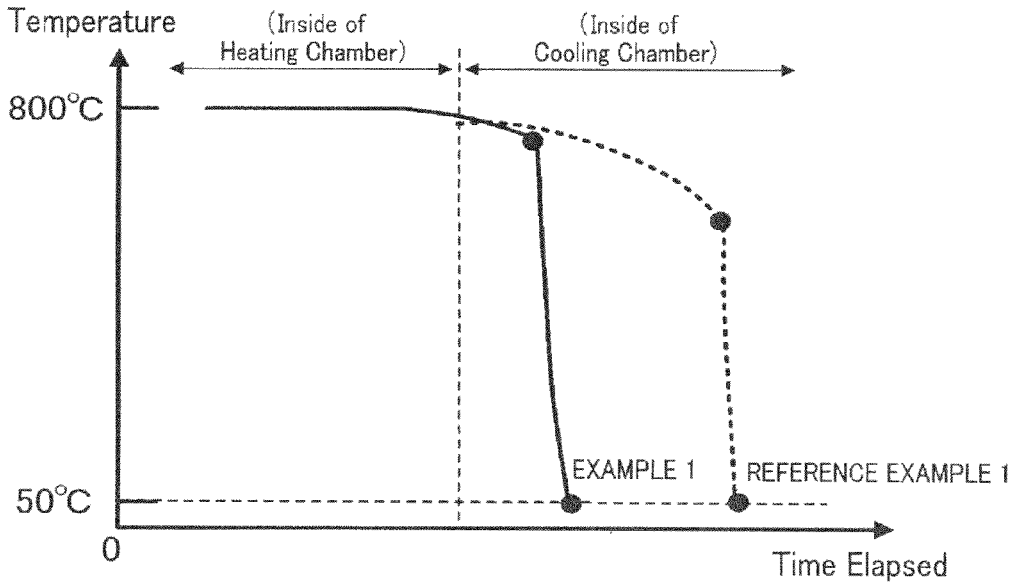
FIG. 7 is a graph showing temperature changes of Example 1 and Reference Example 1.
Figure 8:
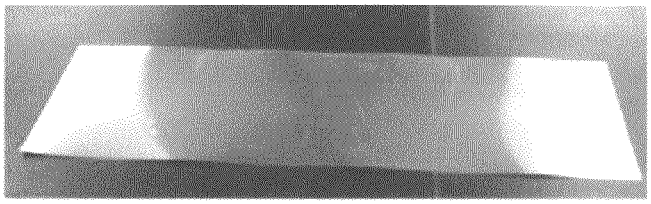
FIG. 8 is a photograph of an alloy strip of Example 1.
Figure 9:
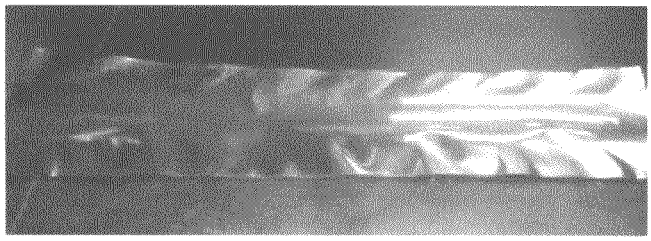
FIG. 9 is a photograph of an alloy strip of Reference Example 1.

The alloy strips of Examples 1 through 24 and Reference Examples 1 through 3 were evaluated for the temperature decrease rate, the surface condition, and the shape. FIG. 7 is a graph showing temperature changes of Example 1 and Reference Example 1. FIG. 8 is a photograph of the alloy strip of Example 1 and FIG. 9 is a photograph of the alloy strip of Reference Example 1. The alloy strips of Example 1 through 7, Examples 12 through 24, and Reference Example 1 through 3 were subjected to aging treatment and were evaluated for the Vickers hardness after the aging treatment. The results of these evaluations are shown in Tables 1 and 2. Table 1 also includes the composition of each material alloy strip, the thickness (T) of the material alloy strip, the heating temperature, the diameter (D) of cooling rolls, the D/T ratio of the diameter of the cooling rolls to the thickness of the material alloy strip, the number of cooling rolls, the film thickness of hard Cr plating, the rotation or non-rotation of cooling rolls, the pressure ratio, and the out-furnace temperature. The method of determining the temperature decrease rate measured the temperature of each material alloy strip with a thermocouple welded to the surface of the alloy strip and calculated a temperature decrease rate $V=(T_0-50)-(t_1-t_0)$ from a time $t_0$ when the material alloy strip entered the cooling chamber, a temperature $T_0$ at the time $t_0$, and a time $t_1$ when the material alloy strip was cooled down to 50° C. The surface condition was visually checked when each material alloy strip was discharged from the cooling chamber. The color change of the surface was observed to evaluate the restriction state of oxide coating. The evaluated surface condition was expressed by the following symbols: the double circle representing substantially no color change, the open circle representing slight color change, and the open triangle representing noticeable color change. The shape was visually checked when each material alloy strip was discharged from the cooling chamber. The evaluated shape was expressed by the following symbols: the double circle representing favorable shape, the open circle representing the presence of slight shape defect, and the open triangle representing the presence of noticeable shape defect. The Vickers hardness was determined according to the following procedure. A test piece of 30 cm in length was cut from each alloy strip and was soaked with stirring in a 15 vol % aqueous solution of nitric acid for 60 seconds for removal of oxide coating. The test piece was cold rolled by a constant plate thickness decrease rate of 15% with a small-sized rolling mill, was subjected to age hardening treatment for 2.5 hours in a nitrogen-replaced heat treat furnace kept at a temperature of 315° C., and was cooled down with water. Part of the age-hardened test piece was cut out and was embedded in a thermosetting resin. After surface polishing, the hardness of the cross section of each embedded test piece was measured. The measurement followed JIS Z2244 to determine the Vickers hardness.

TABLE 1

| | Mateiral alloy strip | | | Cooling rolls | | Result |
|---|---|---|---|---|---|---|
| | Base | Moving speed m/min | Moving speed mm/s | Contact time[1)] s | Diameter mm | Temperature decrease rate ° C./s |
| EXAMPLE 1 | Cu—Be | 1.5 | 25.0 | 1.2 | 120 | 416 |
| EXAMPLE 2 | Cu—Be | 1.5 | 25.0 | 0.8 | 60 | 340 |
| EXAMPLE 3 | Cu—Be | 0.5 | 8.3 | 1.8 | 200 | 277 |
| EXAMPLE 4 | Cu—Be | 1.5 | 25.0 | 1.2 | 120 | 326 |
| EXAMPLE 5 | Cu—Be | 1.8 | 30.0 | 1.0 | 120 | 375 |
| EXAMPLE 6 | Cu—Be | 0.3 | 5.0 | 1.4 | 120 | 441 |
| EXAMPLE 7 | Cu—Be | 1.5 | 25.0 | 1.2 | 120 | 375 |
| EXAMPLE 8 | Cu—Ni—Si | 1.0 | 16.7 | 1.3 | 120 | 363 |
| EXAMPLE 9 | Cu—Ni—Si | 1.0 | 16.7 | 1.3 | 120 | 388 |
| EXAMPLE 10 | Cu—Cr—Zr | 1.0 | 16.7 | 1.3 | 120 | 281 |
| EXAMPLE 11 | Cu—Cr—Zr | 1.2 | 20.0 | 1.2 | 120 | 342 |
| EXAMPLE 12 | Cu—Be | 1.5 | 25.0 | 0.6 | 50 | 170 |
| EXAMPLE 13 | Cu—Be | 0.5 | 8.3 | 2.2 | 240 | 214 |
| EXAMPLE 14 | Cu—Be | 1.5 | 25.0 | 1.2 | 120 | 441 |
| EXAMPLE 15 | Cu—Be | 1.5 | 25.0 | 1.2 | 120 | 197 |
| EXAMPLE 16 | Cu—Be | 1.5 | 25.0 | 1.2 | 120 | 340 |
| EXAMPLE 17 | Cu—Be | 1.5 | 25.0 | 1.2 | 120 | 357 |
| EXAMPLE 18 | Cu—Be | 1.5 | 25.0 | 1.2 | 120 | 326 |
| EXAMPLE 19 | Cu—Be | 6.0 | 100.0 | 0.6 | 240 | 302 |
| EXAMPLE 20 | Cu—Be | 11.0 | 183.0 | 0.4 | 240 | 293 |
| EXAMPLE 21 | SUS630 | 5.5 | 92.0 | 0.9 | 200 | 333 |
| EXAMPLE 22 | SUS630 | 2.5 | 41.7 | 1.0 | 120 | 366 |
| EXAMPLE 23 | 6061Al | 2.5 | 41.7 | 1.2 | 200 | 290 |
| EXAMPLE 24 | 6061Al | 1.2 | 20.0 | 1.1 | 120 | 302 |
| COMPARATIVE EXAMPLE 1 | Cu—Be | 1.5 | 25.0 | — | — | 65 |
| COMPARATIVE EXAMPLE 2 | SUS630 | 2.5 | 41.7 | — | — | 212 |
| COMPARATIVE EXAMPLE 3 | 6061Al | 1.8 | 30.0 | — | — | 162 |

[1)]Contact time is obtained from the temperature profile of measurements of time from start of contact to separation

TABLE 2

| | Material alloy strip | | Heating | Cooling rolls | | | | | |
|---|---|---|---|---|---|---|---|---|---|
| | Base | Thickness T mm | temperature ° C. | Diameter D mm | D/T — | Number of Pairs | Film thickness μm | Synchronous rotation — | Pressure ratio — |
| EXAMPLE 1 | Cu—Be | 0.27 | 800 | 120 | 444 | 1 | 5 | Yes | 1/10 |
| EXAMPLE 2 | Cu—Be | 0.27 | 800 | 60 | 222 | 1 | 5 | Yes | 1/10 |
| EXAMPLE 3 | Cu—Be | 0.10 | 800 | 200 | 2000 | 1 | 5 | Yes | 1/10 |
| EXAMPLE 4 | Cu—Be | 0.27 | 800 | 120 | 444 | 1 | 97 | Yes | 1/10 |
| EXAMPLE 5 | Cu—Be | 0.30 | 800 | 120 | 400 | 1 | 5 | Yes | 1/5 |
| EXAMPLE 6 | Cu—Be | 0.08 | 800 | 120 | 1500 | 1 | 5 | Yes | 1/50 |
| EXAMPLE 7 | Cu—Be | 0.27 | 800 | 120 | 444 | 3 | 5 | Yes | 1/10 |
| EXAMPLE 8 | Cu—Ni—Si | 0.15 | 800 | 120 | 800 | 1 | 5 | Yes | 1/10 |
| EXAMPLE 9 | Cu—Ni—Si | 0.15 | 700 | 120 | 800 | 1 | 5 | Yes | 1/10 |
| EXAMPLE 10 | Cu—Cr—Zr | 0.20 | 950 | 120 | 800 | 1 | 5 | Yes | 1/10 |
| EXAMPLE 11 | Cu—Cr—Zr | 0.15 | 770 | 120 | 800 | 1 | 5 | Yes | 1/10 |
| EXAMPLE 12 | Cu—Be | 0.27 | 800 | 50 | 185 | 1 | 5 | Yes | 1/10 |
| EXAMPLE 13 | Cu—Be | 0.10 | 800 | 240 | 2400 | 1 | 5 | Yes | 1/10 |
| EXAMPLE 14 | Cu—Be | 0.27 | 800 | 120 | 444 | 1 | 2 | Yes | 1/10 |
| EXAMPLE 15 | Cu—Be | 0.27 | 800 | 120 | 444 | 1 | 120 | Yes | 4 |
| EXAMPLE 16 | Cu—Be | 0.27 | 800 | 120 | 444 | 1 | 5 | No | — |
| EXAMPLE 17 | Cu—Be | 0.27 | 800 | 120 | 444 | 1 | 5 | Yes | 1/100 |
| EXAMPLE 18 | Cu—Be | 0.27 | 800 | 120 | 444 | 1 | 5 | Yes | 1/2 |
| EXAMPLE 19 | Cu—Be | 0.60 | 800 | 240 | 400 | 1 | 5 | Yes | 1/10 |
| EXAMPLE 20 | Cu—Be | 0.95 | 800 | 240 | 253 | 1 | 5 | Yes | 1/10 |
| EXAMPLE 21 | SUS630 | 0.80 | 1060 | 200 | 250 | 2 | 5 | Yes | 1/5 |
| EXAMPLE 22 | SUS630 | 0.30 | 1060 | 120 | 400 | 1 | 5 | Yes | 1/10 |
| EXAMPLE 23 | 6061Al | 0.90 | 530 | 200 | 222 | 1 | 5 | Yes | 1/10 |
| EXAMPLE 24 | 6061Al | 0.40 | 520 | 120 | 300 | 1 | 5 | Yes | 1/10 |
| COMPARATIVE EXAMPLE 1 | Cu—Be | 0.27 | 800 | None (cooled down by spraying water) | | | | | |
| COMPARATIVE EXAMPLE 2 | SUS630 | 0.30 | 1060 | None (cooled down by spraying water) | | | | | |

TABLE 2-continued

| | | | | |
|---|---|---|---|---|
| COMPARATIVE EXAMPLE 3 | 6061Al | 0.40 | 520 | None (cooled down by spraying water) |

| | Out-furnace temlerature ° C. | Result: Temperature decrease rate ° C./s | Surface condition — | Shape — | Hardness[1)] Hv |
|---|---|---|---|---|---|
| EXAMPLE 1 | 41 | 416 | ◎ | ◎ | 456 |
| EXAMPLE 2 | 42 | 340 | ◎ | ◎ | 433 |
| EXAMPLE 3 | 37 | 277 | ◎ | ◎ | 438 |
| EXAMPLE 4 | 40 | 326 | ◎ | ◎ | 444 |
| EXAMPLE 5 | 43 | 375 | ◎ | ◎ | 445 |
| EXAMPLE 6 | 37 | 441 | ◎ | ◎ | 452 |
| EXAMPLE 7 | 22 | 375 | ◎ | ◎ | 434 |
| EXAMPLE 8 | 36 | 363 | ◎ | ◎ | — |
| EXAMPLE 9 | 28 | 388 | ◎ | ◎ | — |
| EXAMPLE 10 | 44 | 281 | ◎ | ◎ | — |
| EXAMPLE 11 | 26 | 342 | ◎ | ◎ | — |
| EXAMPLE 12 | 47 | 170 | ◎ | ◎ | 388 |
| EXAMPLE 13 | 44 | 214 | ◎ | ◎ | 390 |
| EXAMPLE 14 | 28 | 441 | ◎ | ○ | 432 |
| EXAMPLE 15 | 44 | 197 | ◎ | ◎ | 382 |
| EXAMPLE 16 | 35 | 340 | ◎ | ○ | 441 |
| EXAMPLE 17 | 36 | 357 | ◎ | ○ | 440 |
| EXAMPLE 18 | 32 | 326 | ◎ | ○ | 432 |
| EXAMPLE 19 | 49 | 302 | ◎ | ○ | 388 |
| EXAMPLE 20 | 49 | 293 | ◎ | ○ | 379 |
| EXAMPLE 21 | 65 | 333 | ◎ | ◎ | 354 |
| EXAMPLE 22 | 54 | 366 | ◎ | ◎ | 367 |
| EXAMPLE 23 | 43 | 290 | ◎ | ◎ | 120 |
| EXAMPLE 24 | 41 | 302 | ◎ | ◎ | 126 |
| COMPARATIVE EXAMPLE 1 | 22 | 65 | Δ | Δ | 368 |
| COMPARATIVE EXAMPLE 2 | 29 | 212 | Δ | Δ | 301 |
| COMPARATIVE EXAMPLE 3 | 25 | 162 | Δ | Δ | 98 |

[1)]Hardness after aging treatment (Hardness after standard T6 aging treatment for 6061 aluminum)

The alloy strips of Examples 1 through 20 had the better properties than the alloy strip of Reference Example 1 with regard to all the temperature decrease rate, the surface condition, the shape, and the Vickers hardness. The production equipment of the invention adopting the pair of cooling rolls in the solution treatment process effectively quenched the alloy strip and gave the precipitation hardened alloy strip having the favorable shape and the favorable surface condition. Especially preferable properties of the temperature decrease rate, the surface condition, the shape, and the Vickers hardness were obtained in Examples 1 through 11 where the material alloy strip had the thickness of not greater than 0.30 mm, the D/T ratio in a range of not lower than 222 and not higher than 2000, the film thickness of the hard Cr plating on the surface of the cooling rolls in a range of not less than 5 μm and not greater than 97 μm, and the pressure ratio in a range of not lower than 1/50 and not higher than 1/5. These Examples adopted the cooling rolls of the greater diameters to give the higher D/T ratios, compared with Example 12 adopting the cooling rolls of 50 mm in diameter and having the D/T ratio of 185. This would result in assuring the more sufficient capacity of the cooling fluid flow and enhancing the temperature decrease rate. These Examples also adopted the cooling rolls of the not excessively large but adequately large diameters, compared with Example 13 adopting the cooling rolls of 240 mm in diameter and having the D/T ratio of 2400. This would result in shortening the distance and the time until the first contact of the alloy strips with the cooling rolls and enhancing the temperature decrease rate. These Examples had the substantially homogeneous and difficult-to-peel plating on the surface of the cooling rolls, compared with Example 14 having the hard Cr plating of 2 μm in film thickness. This would result in giving the favorable shape. These Examples had the less decrease in heat conductivity by the hard Cr plating, compared with Example 15 having the hard Cr plating of 120 μm in film thickness. This would result in attaining the preferable temperature decrease rate. Compared with Example 16 with no rotation of the cooling rolls, these Examples had the lower potential for damage due to dragging by the cooling rolls. This would result in giving the favorable shape. Compared with Example 17 having the pressure ratio of 1/100, these Examples had the higher pressure ratios. This would result in well correcting the shape. Compared with Example 18 having the pressure ratio of 1/2 to reduce the plate thickness, these Examples had the not excessively high but adequately high pressure ratio. This would result in adequately correcting the shape. Even in Example 19 having the material alloy strip of 0.60 mm in thickness and Example 20 having the material alloy strip of 0.95 mm in thickness, setting the D/T ratio in the range of not lower than 222 and not higher than 2000 gave the preferable properties of the temperature decrease rate, the surface condition, the shape, and the Vickers hardness.

Examples 1 through 11 had the temperature decrease rate of not lower than 275° C./s and gave the alloy strips in the favorable supersaturated state with the effective restriction of oxide coating and the good shape. The alloy strips of these Examples were sufficiently cooled down to the same temperature when being discharged out of the cooling chamber.

In Examples 1 through 11, 14, and 16 through 18 that attained the sufficiently high temperature decrease rate of not lower than 275° C./s after the solution treatment, the precipitation hardened alloys or more specifically the precipitation hardened Cu—Be—Co alloys had the preferable Vickers hardness of not lower than 430 Hv. Namely the solution treatment would give the solid solutions in the favorable supersaturated state in these Examples.

Not only the Cu—Be—Co alloy compositions but the Cu—Ni—Si alloy compositions and the Cu—Cr—Zr alloy compositions allowed the alloy strips to be quenched and to have the favorable surface condition and the good shape. Namely the production equipment of the invention would be applicable to any of the precipitation hardened copper alloys.

Examples 21 and 22 using the stainless steel (SUS630) for the material alloy strip gave the better properties with regard to all the temperature decrease rate, the surface condition, the shape, and the Vickers hardness, compared with Reference Example 2. Examples 23 and 24 using the aluminum alloy (A6061) for the material alloy strip gave the better properties with regard to all the temperature decrease rate, the surface condition, the shape, and the Vickers hardness, compared with Reference Example 3. Namely the production equipment of the invention adopting the pair of cooling rolls to cool down the heated material alloy strip in the solution treatment process would be applicable to any of various precipitation hardening alloys to quench the alloy strip and give the precipitation hardening alloy strip having the favorable surface condition and the good shape.

The present application claims priority from Japanese Patent Application No. 2009-243580 filed on Oct. 22, 2009, the entire contents of which are incorporated herein by reference.

What is claimed is:

1. A production method for forming a precipitation hardened alloy strip, comprising:

a heating step of heating a material alloy strip having a precipitation hardening alloy composition to a temperature of not lower than a recrystallization temperature but not higher than a melting point in a heating chamber; and a cooling step of passing the heated material alloy strip through a pair of cooling rolls that are positioned outside the heating chamber, thereby cooling down the heated material alloy strip, wherein said cooling rolls are the first rolls to contact the alloy strip in the production method, and wherein the cooling step cools down the material alloy strip at a temperature decrease rate of not lower than 275° C./s and not higher than 500° C./s until the temperature of the material alloy strip is lowered to or below 50° C.

2. The production method of the precipitation hardened alloy strip according to claim 1, wherein the cooling step presses the material alloy strip via the pair of cooling rolls at a pressure of not lower than 1/50 and not higher than 1/5 of an elastic limit of the material alloy strip after being cooled down.

3. The production method of the precipitation hardened alloy strip according to claim 1, wherein multiple pairs of cooling rolls are used in the cooling step.

4. The production method of the precipitation hardened alloy strip according to claim 1, wherein in the cooling step the pair of cooling rolls are in a cooling chamber that is directly adjacent to and abutted against the heating chamber, and wherein a pressure difference between the heating chamber and the cooling chamber is not lower than 100 hPa and not higher than 500 hPa.

* * * * *